US005127304A

United States Patent [19]

Suzuki et al.

[11] Patent Number: 5,127,304

[45] Date of Patent: Jul. 7, 1992

[54] ENVELOPE SIGNAL GENERATING APPARATUS

[75] Inventors: Takashi Suzuki; Yutaka Washiyama, both of Hamamatsu, Japan

[73] Assignee: Kabushiki Kaisha Kawai Gakki Seisakusho, Japan

[21] Appl. No.: 619,863

[22] Filed: Nov. 29, 1990

[30] Foreign Application Priority Data

Aug. 21, 1990 [JP] Japan ..... 2-218237
Aug. 21, 1990 [JP] Japan ..... 2-218238

[51] Int. Cl.[5] ..... G10H 1/057; G10H 7/00

[52] U.S. Cl. ..... 84/627; 84/663

[58] Field of Search ..... 84/627, 663, 702, 703, 84/738

[56] References Cited

U.S. PATENT DOCUMENTS 4,135,424 1/1979 Okamoto .
4,178,826 12/1979 Hiyoshi et al. .
4,185,532 1/1980 Hiyoshi et al. .
4,691,608 9/1987 Sasaki et al. ..... 84/627 X
5,038,661 8/1991 Kaneko ..... 84/627 X

*Primary Examiner*—Stanley J. Witkowski
*Attorney, Agent, or Firm*—Andrus, Sceales, Starke & Sawall

[57] ABSTRACT

A differentiation circuit outputs a normalized time variable signal for each phase. This time variable signal is multiplied by a gain parameter by a multiplier, thus reproducing an AC amplitude level lost in normalization. The reproduced output is added to an amplitude parameter by an adder, thus reproducing a DC amplitude level lost in the normalization. A CPU reads out the parameters of the differentiation circuit and adder from an ROM, and writes them into a parameter memory. When phase-change data is detected, the content of the parameter memory is rewritten, thereby forcibly changing the phase.

11 Claims, 12 Drawing Sheets

ENVELOPE SIGNAL GENERATING APPARATUS

BACKGROUND OF THE INVENTION

1. Field of the Invention

The present invention relates to an envelope signal generating apparatus installed in, for example, an electronic musical instrument.

2. Description of the Related Art

An envelope signal generating apparatus is generally installed in an electronic musical instrument, such as an electronic organ, to multiply a tone signal by an envelope signal, providing a dynamics-added musical tone signal.

Conventional envelope signal generating apparatuses generate an envelope signal using a parameter indicating a target level and a parameter indicating a time to reach the target level. The structure to generate an envelope signal based on the target level, however, has the following shortcomings:

1) Even in phases (wave transitional phases) with the same time interval, changing the target level varies the wave generating time.

2) Every time the target level changes, it is necessary to recompute what is to be compared for discriminating whether or not the target level has been reached.

3) A small change in target level increases a computation error so that the desired waveform cannot be acquired.

The conventional envelope signal generating apparatuses manage the parameters for each envelope signal. With this design, however, the phase cannot be changed, even forcibly, during wave generation for the following reason. As the parameters are managed for each envelope signal, when phase alteration is executed, the changed phase always becomes the head phase of one envelope signal.

SUMMARY OF THE INVENTION

It is therefore a primary object of the present invention to provide an envelope signal generating apparatus which 1) does not change the wave generating time even when the target level is altered, 2) does not require changing what is to be compared for discriminating whether or not the target level has been reached every time the target level is altered, and 3) can acquire the desired waveform even when a change up to the target level is small.

This primary object can be achieved by the first embodiment of the present invention according to which an envelope signal generating apparatus comprises:

time variable signal generating means for generating a normalized time variable signal for each phase of a desired envelope signal;

AC amplitude level reproducing means for processing the time variable signal from the time variable signal generating means to reproduce an AC amplitude level thereof lost by normalization; and DC amplitude level reproducing means for processing the time variable signal whose AC amplitude level has been reproduced by the AC amplitude level reproducing means to reproduce a DC amplitude level thereof lost by the normalization, thereby producing the desired envelope signal.

With the above arrangement which generates a normalized time variable signal and reproduces the AC amplitude level and DC amplitude level of this time variable signal to generate an envelope signal, the envelope signal can be generated irrespective of the target level. Accordingly, the first object can be achieved.

It is another object of the present invention to provide an envelope signal generating apparatus which can forcibly change the phase during wave generation.

This second object is achieved by the second and third embodiments of the present invention.

An envelope signal generating apparatus according to the second embodiment comprises:

phase discriminating means for discriminating phases of a selected envelope signal;

wave generating means for sequentially generating waveforms of individual phases discriminated by the phase discriminating means to thereby acquire a desired envelope signal; and phase change means for forcibly altering that phase whose waveform is being generated by the wave generating means based on phase-change data.

With the above arrangement, the wave generating means manages waveform generating data for each phase, not for the envelope signal, thus permitting forced alteration of the phase during wave generation. In addition, even though the waveform generating data is managed for each phase, the selected envelope signal can be generated without problems because the phase discriminating means determines the phases of the selected envelope signal.

An envelope signal generating apparatus according to the third embodiment of the present invention comprises:

first memory means for storing waveform generating data for one phase;

second memory means for storing waveform generating data for a phase next to that phase whose associated waveform generating data is stored in the first memory;

wave generating means for generating a waveform based on the waveform generating data stored in the first memory;

first transfer means for transferring the waveform generating data stored in the second memory means to the first memory means after wave generation by the wave generating means based on the waveform generating data stored in the first memory means is completed;

first writing means for writing waveform generating data for a next phase into the second memory means after data transfer by the first transfer means is completed;

change data detecting means for detecting phase-change data for changing a phase whose associated waveform is being generated by the wave generating means;

second writing means for writing, into the second memory means, waveform generating data for generating a waveform of that phase which is specified by the phase-change data upon detection of the phase-change data by the change data detecting means; and second transfer means for transferring the waveform generating data, written into the second memory means by the second writing means, into the first memory means after writing of the waveform generating data by the second writing means is done.

With the above arrangement, the second writing means serves as a buffer memory. If waveform generating data is managed for each envelope signal, therefore, this data is managed in the first and second memory means for each phase. Accordingly, replacing waveform generating data in the second memory means can forcibly change the phase.

BRIEF DESCRIPTION OF THE DRAWINGS

FIG. 3(*a*) depicts several normalized time variable signals, each corresponding to a particular waveform portion or phase.

FIG. 3(*b*) depicts the reproduced AC amplitude levels resulting from the processed time variable signals of FIG. 3(*a*).

FIG. 3(*c*) depicts the desired envelope signal or DC amplitude levels derived by processing the reproduced AC amplitude levels.

FIG. 5(*a*) depicts several normalized time variable signals $\alpha p$, each of which is output as a linear waveform signal from the differentiation circuit for a particular waveform portion or phase.

FIG. 5(*b*) depicts the request signal REQ that is sent to a control signal generator when the output $\alpha p$ of the differentiation circuit falls below the threshold level TL in FIG. 5(*a*).

FIG. 5(*c*) depicts a write flat signal $W_{flg}$ which has been set to "0", indicating that no phase-change data has been detected.

FIG. 5(*d*) depicts the reproduced AC amplitude level resulting from the processed time variable signals of FIG. 5(*a*).

FIG. 5(*e*) depicts an exponential functional waveform derived from main AC amplitude level of FIG. 5(*d*) by using a logarithm/linear conversion.

FIG. 5(*f*) depicts the desired envelope signal, or DC amplitude level, derived by processing the exponential functional waveform of FIG. 5(*e*).

FIG. 10(*a*) depicts several normalized time variable signals $\alpha p$, each of which is output as linear waveform signal from the differentiation circuit for a particular waveform portion or phase.

FIG. 10(*b*) depicts the request signal REQ that is sent to a control signal generator when the output $\alpha p$ of the differentiation circuit falls below the threshold level TL in FIG. 10(*a*).

FIG. 10(*c*) depicts a write flat signal $W_{flg}$ which is set to "1" during the attack phase to indicate that a new waveform is to be forcibly produced.

FIG. 10(*d*) depicts the reproduced AC amplitude level resulting from the processed time variable signals of FIG. 10(*a*).

FIG. 10(*e*) depicts an exponential functional waveform derived from the AC amplitude level of FIG. 10(*d*), by using a logarithm/linear conversion.

FIG. 10(*f*) depicts the desired envelope signal, or DC amplitude level, derived by processing the exponential functional waveform of FIG. 10(*e*).

DETAILED DESCRIPTION OF THE PREFERRED EMBODIMENTS

Figure 1:
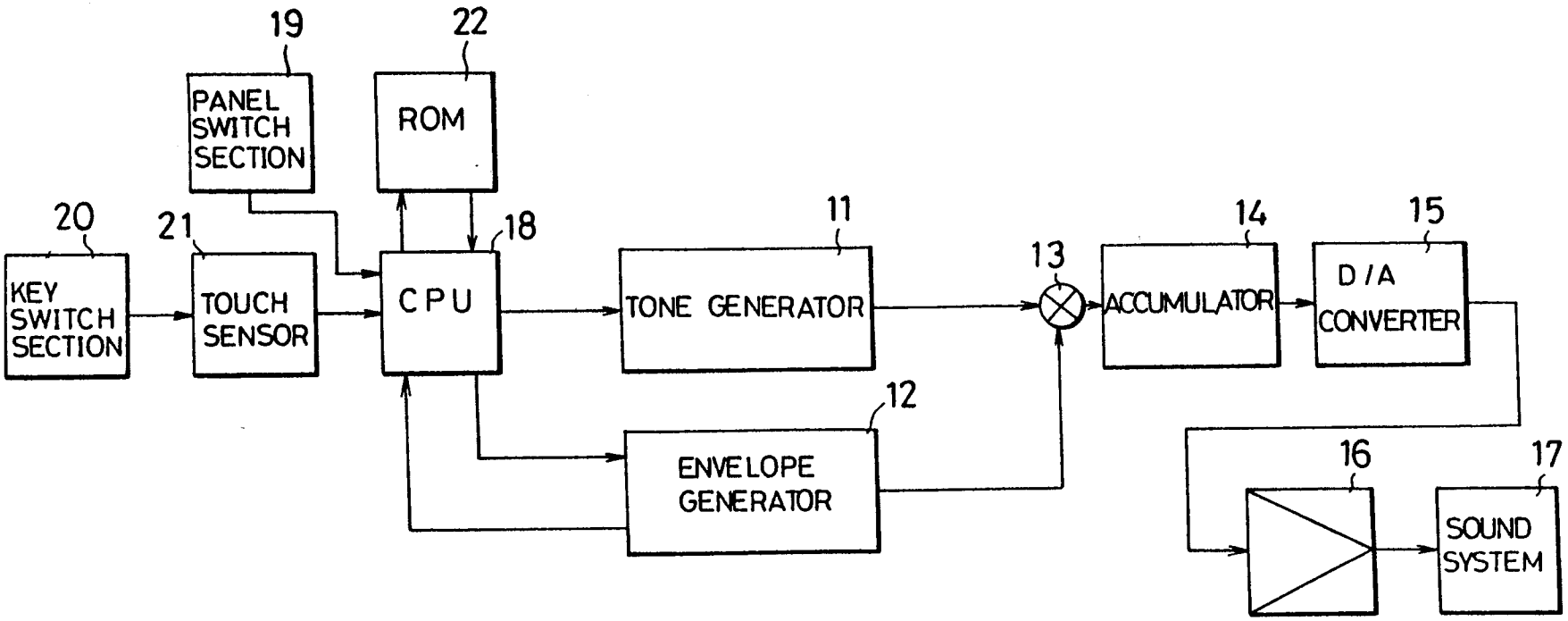
FIG. 1 is a block diagram exemplifying the structure of a musical tone generating apparatus to which an envelope signal generating apparatus embodying the present invention is applied.

Preferred embodiments of the present invention will now be described with reference to the accompanying drawings.

To begin with, one example of an electronic musical instrument using an envelope signal generating apparatus of the present invention will be described referring to FIG. 1 for easier understanding of the present invention.

Referring to the diagram, a tone generator 11 outputs tone signals of individual tone-ON channels on a time-divisional basis, and an envelope generator 12 outputs envelope signals of individual tone-ON channels on a time-divisional basis. The signal generating operations of these generators 11 and 12 are controlled by a central processing unit (hereinafter referred to as "CPU") 18.

Signals output from both generators 11 and 12 are multiplied by a multiplier 13 to be a musical tone signal added with dynamics in the amplitude direction.

The musical tone signal from the multiplier 13 is accumulated by an accumulator 14 so that musical tone signals of individual tone-ON channels are synthesized.

A musical tone signal output from the accumulator 14 is converted into an analog signal by an analog/digital (A/D) converter 15. This analog signal is supplied via an amplifier 16 to a sound system 17, which comprises a loudspeaker or a headphone to generate an input signal as a musical tone.

A panel switch section 19 has various switches including a timbre/envelope select switch for selecting a timbre and an envelope signal for each tone-ON channel. The switch operating status of the panel switch section 19 is detected by a panel scan circuit (not shown). The detection output from this panel scan circuit is supplied as a panel switch code to the CPU 18.

Reference numeral "20" denotes a key switch section The operational status of the key switch section 20 is detected by a touch sensor 21 and its detection output is supplied to the CPU 18. The detection output includes a key code indicating a key depressed or released and touch data indicating the strength of key depression.

A read-only memory (ROM) 22 stores a program for controlling the operation of the CPU 18, a plurality of timbre codes specifying timbres, a frequency number specifying the frequency of a tone signal, parameters for generating envelope signals and other various fixed data.

The parameters for generating envelope signals are stored for each phase, not for each envelope signal.

The signal generating operation of the tone generator 11 is controlled as follows.

The CPU 18 reads out from the ROM 22 a timbre code that specifies a timbre selected by the timbre/envelope select switch of the panel switch section 19, and sends it to the tone generator 11.

The CPU 18 sends a key code from the touch sensor 21 as data indicating the tone range to the tone generator 11. Further, the CPU 18 reads a frequency number corresponding to the pitch specified by this key code, from the ROM 22 and sends it to the tone generator 11.

The tone generator 11 is provided with a wave memory which stores plural pieces of waveform data having waveforms corresponding to the timbres and tone ranges. One of plural pieces of waveform data is selected on the basis of the timbre code and key code supplied from the CPU 18. The selected waveform data is read out at a speed specified by the frequency number also supplied from the CPU 18, providing a tone signal having a waveform corresponding to the timbre and tone range and a frequency corresponding to the pitch.

The signal generating operation of the envelope generator 12 is controlled as follows.

The CPU 18 determines a plurality of phases of an envelope signal selected by the timbre/envelope select switch. Parameters of the determined phases are sequentially read out from the ROM 22 in synchronization with, for example, the wave generation operation, and supplied to the envelope generator 12. Based on the sequentially supplied parameters, the envelope generator 12 generates waveforms of individual phases, thus providing the desired envelope signal.

The CPU 18 performs detection of phase-change data while the envelope generator 12 is producing the envelope signal. When phase-change data is detected, the CPU 18 reads out a parameter of a phase specified by this phase-change data, from the ROM 22. The parameter supplied to the envelope generator 12 is replaced by this read parameter. As a result, the phase is forcibly changed even during wave generation.

The phase-change data includes after touch data, acquired from touch data output from the touch sensor 21, and key-OFF data.

The above is the description of one example of an electronic musical instrument to which the envelope signal generating apparatus embodying the present invention is applied.

Figure 2:
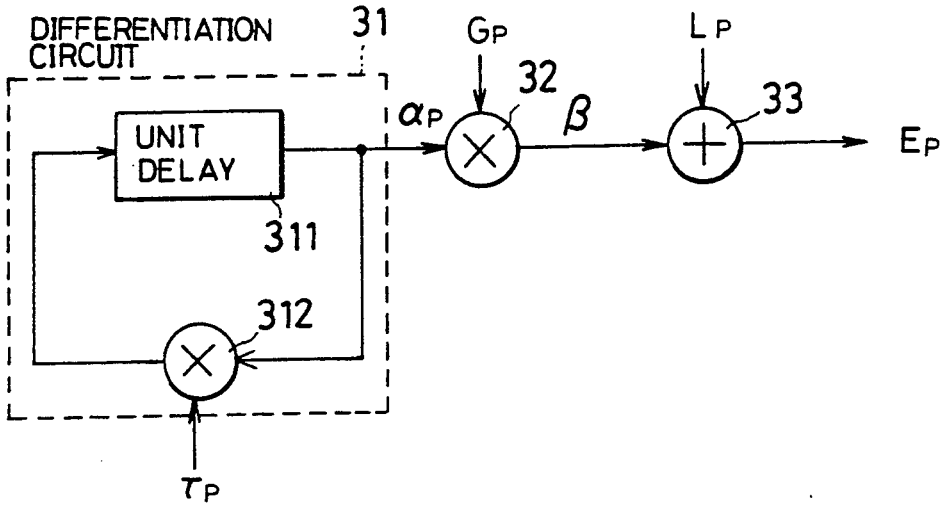
FIG. 2 is a block diagram illustrating the structure of the first embodiment of the present invention.

FIG. 2 is a circuit diagram illustrating the structure of the first embodiment of the present invention.

Figure 3:
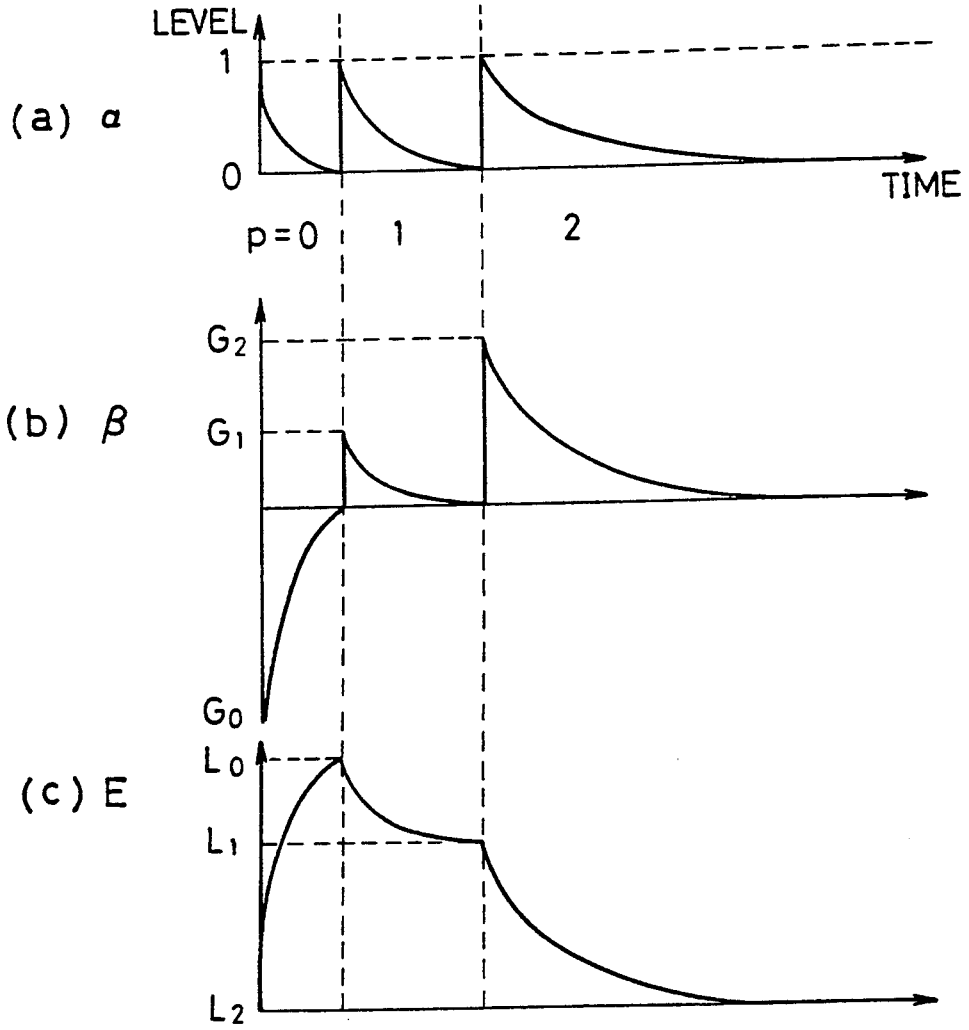
FIGS. 3(*a*)–3(*c*) are signal waveform diagrams relating to the operation of the circuit depicted in FIG. 2.

FIGS. 3(*a*)–3(*c*) are signal waveform diagrams for explaining the operation of the circuit shown in FIG. 2.

Referring to FIGS. 3(*a*)–3(*c*), "P" denotes phases at which the transition of waveform occurs, such as the attack portion, decay portion, sustain portion and release portion.

Let us assume that an envelope signal as shown in FIG. 3(*c*) is to be generated.

To generate this envelope signal according to this embodiment, a normalized time variable signal is produced for each phase P (see FIG. 3(*a*)). That is, a waveform whose amplitude at each point in each phase is divided by the maximum amplitude of that phase is generated.

Then, this time variable signal is subjected to processing to reproduce the AC amplitude level lost in the normalization (see FIG. 3(*b*)).

Finally, the signal with the reproduced AC amplitude level is subjected to processing to reproduce the DC amplitude level lost in the normalization (see FIG. 3(*c*)), thus providing the desired envelope signal.

The structure shown in FIG. 2 will now be described.

Referring to this diagram, a differentiation circuit 31, which produces a normalized time variable signal, comprises a unit delay circuit 311 and a multiplier 312.

In the unit delay circuit 311, an initial value "11" is set at a position where transition of the phase P occurs. This initial value "1" is supplied to the multiplier 312 where it is multiplied by a time parameter $\tau_P$. This time parameter $\tau_P$, which specifies a time to reach the target level, has a value $0<\tau<1$.

The multiplied output from the multiplier 312 is delayed by a unit time by the unit delay circuit 311. The delayed output is supplied to the multiplier 312 to be multiplied again by the time parameter $\tau_P$.

The multiplication is repeated for each unit time thereafter so that the amplitude of the waveform approaches "0." As a result, a normalized waveform as shown in FIG. 3(*a*) is acquired.

The output $\alpha_P$ of the differentiation circuit 31 is sent to a multiplier where it is multiplied by a gain parameter $G_P$ to reproduce the AC amplitude level. This provides a waveform with the reproduced AC amplitude level as shown in FIG. 3(*b*).

The output $\beta_P$ of the multiplier 32 is supplied to an adder 33 where it is added to an amplitude parameter $L_P$ to reproduce the DC amplitude level, providing a waveform with the reproduced DC amplitude level as shown in FIG. 3(*c*).

When wave generation for one phase P is completed, an initial value "1" is set again in the unit delay circuit 311 and parameters $\tau_{P+1}$, $G_{P+1}$ and $L_{P+1}$ for the next phase (P+1) are respectively supplied to the multipliers 312 and 32 and the adder 33. As a result, a wave generating process for the next phase (P+1) will be executed.

The initialization is thereafter performed every time wave generation of each phase P is ended. Accordingly, an envelope signal as shown in FIG. 3(*c*) is generated.

The parameters $\tau_P$ and $L_P$ are supplied to the CPU 18 in FIG. 1, while the parameter $G_P$ is automatically generated inside the envelope generator 12.

The wave generation for each channel is executed time-divisionally for each phase P.

The output $\alpha_P$ of the differentiation circuit 31, the output $\beta_P$ of the multiplier 32 and the output $E_P$ of the adder 33 are respectively given by the following equations (1) to (3).

$$\alpha_{Pn}=\alpha_{P(n-1)}\times\tau_P \quad (1)$$

$$\beta_{Pn}=\alpha_{Pn}\times G_P \quad (2)$$

$$E_{Pn}=\beta_{Pn}+L_P \quad (3)$$

where n is the number of delays of the unit delay circuit 311.

The gain parameter G of the multiplier 32 is expressed by the following equation (4).

$$T_{(P+1)n}=E_{Pn}-L_{P+1} \quad (4)$$

where $T_{(P+1)n}$ is a parameter in one unit time of the next phase (P+1) to the phase P in which a waveform is presently being generated. This parameter $T_{(P+1)n}$ is successively produced during wave generation of one phase P. The parameter $T_{(P+1)n}$, produced at the transitional position of the present phase P to the next phase (P+1), is registered as a gain parameter $G_{P+1}$ for the next phase (P+1).

The equation (4) is determined as to keep the wave continuity at the transitional point of the phase P.

According to this embodiment, as described above, a normalized time variable signal is generated, and the AC amplitude level and DC amplitude level of this time variable signal are reproduced to generate an envelope signal, so that the envelope signal can be generated irrespective of the target level. Further, the wave generating time does not change even when the target level is altered. It is unnecessary to change what is to be compared for discriminating whether or not the target level has been reached every time the target level is altered. Furthermore, the desired envelope waveform can be acquired even when a change up to the target level is small.

Figure 4:
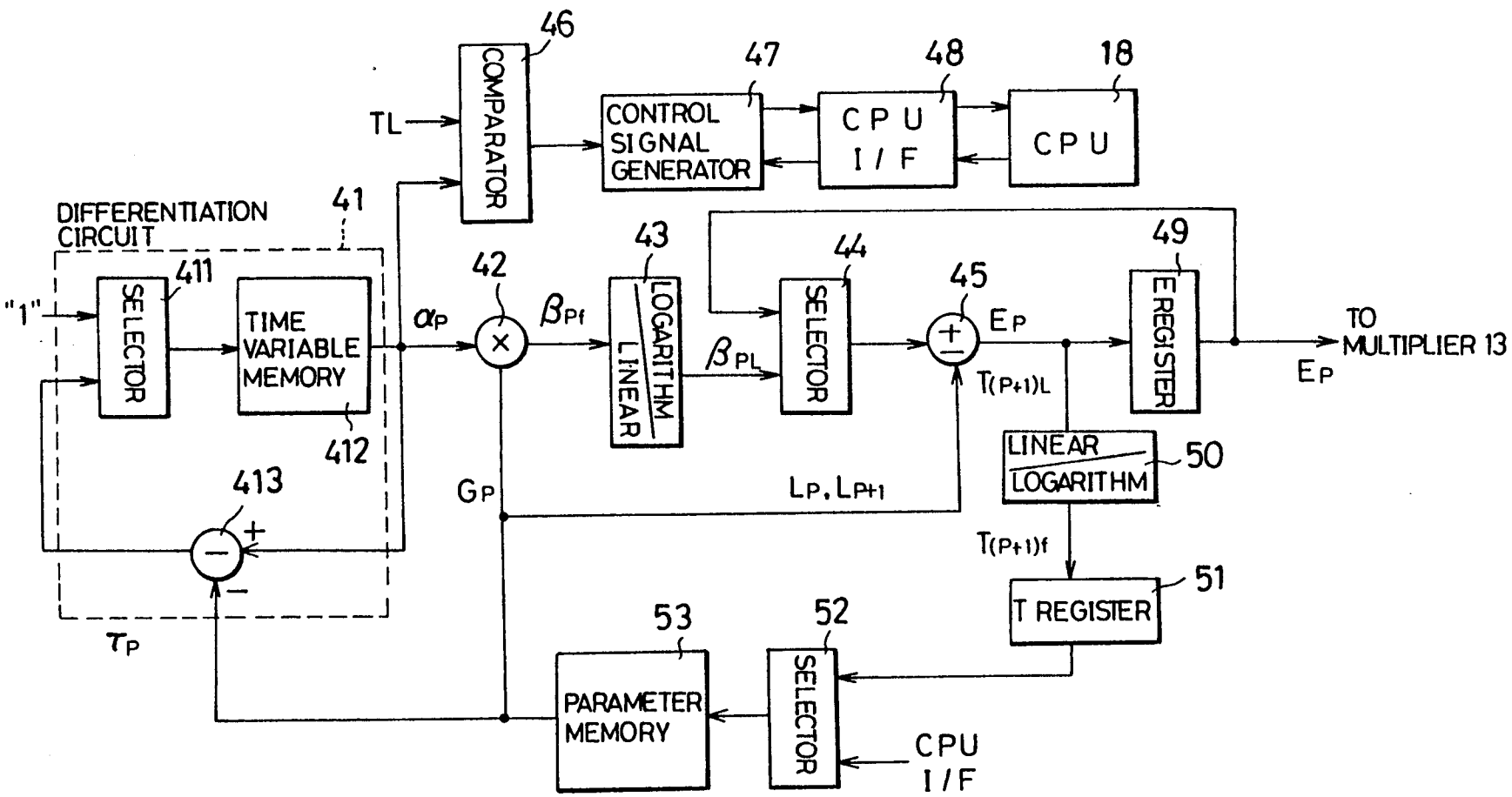
FIG. 4 is a block diagram illustrating the structure of the second embodiment of the present invention.

FIG. 4 is a circuit diagram illustrating the structure of the second embodiment of the present invention.

The description of the previous embodiment has been given with reference to a case where a normalized time variable signal is output as an exponential functional waveform signal. In the second embodiment, a normalized time variable signal is output as a linear waveform signal.

Figure 5:
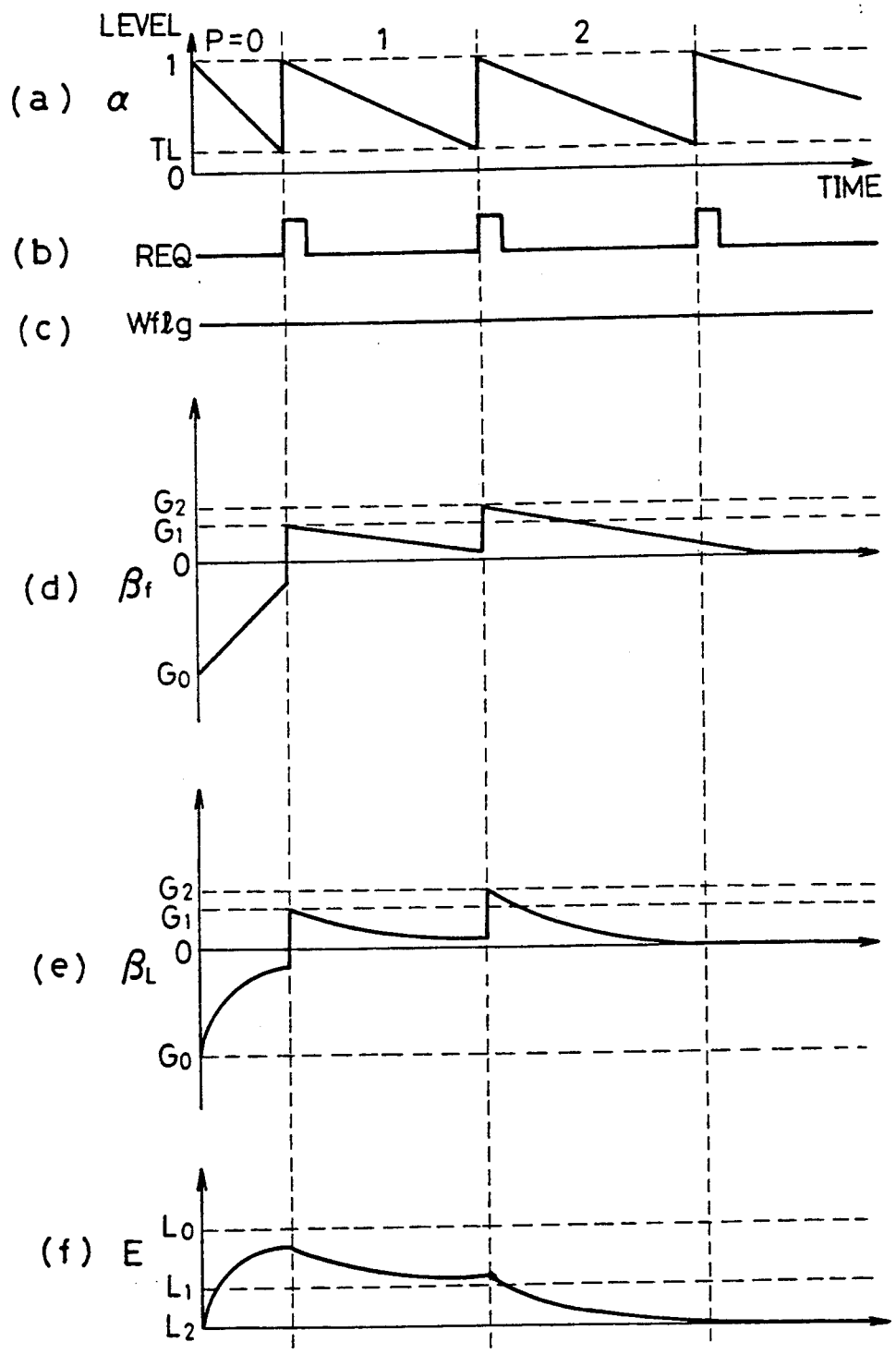
FIGS. 5(*a*)–5(*f*) are signal waveform diagrams relating to the operation of the circuit shown in FIG. 4.

This operation will be briefly described referring to FIGS. 5(*a*)–5(*f*).

Referring to these diagrams, 5(*f*) indicates the desired envelope signal.

To acquire such an envelope signal, the normalized time variable signal is output as a linear waveform signal first (see FIG. 5(*a*)). Then, the time variable signal is processed to have the AC amplitude level reproduced (see FIG. 5(*d*)). Then, the signal with the reproduced AC amplitude level is converted into an exponential functional waveform through logarithm/linear conversion (see FIG. 5(*e*)). Finally, a signal with the exponential functional waveform is subjected to processing to reproduces its DC amplitude level (see FIG. 5(*f*)), thus providing the desired envelope signal.

FIG. 5(*b*) shows a request signal REQ to request transition of the phase P. This request signal REQ is supplied to the CPU 18 from the envelope generator 18 at each transitional point of the phase P. Upon reception of the request signal REQ, the CPU 18 executes the initialization to generate a waveform for the next phase (P+1).

FIG. 5(*c*) shows a write flag $W_{flg}$ indicating whether or not phase-change data is detected. This write flag $W_{flg}$ is set to "0" when no phase-change data is detected and is set to "1" when the phase-change data is detected. FIG. 5(*c*) illustrates the write flag $W_{flg}$ being set to "0" because there is no phase-change data present.

The structure shown in FIG. 4 will now be described.

The illustrated apparatus is generally separated into a structure for generating an envelope signal and a structure for generating a gain parameter $G_P$.

To begin with, the structure for generating an envelope signal will be described below.

Referring to FIG. 4, a differentiation circuit 41, which outputs a normalized time variable signal as a linear waveform signal, comprises a selector 411, a time variable memory 412 and a subtracter 413.

In the time variable memory 412, "1" is written as the initial value at the transitional point of each phase P. This initial value "1" is given via the selector 411 from the CPU 18.

The initial value "1" written in the time variable memory 412 is supplied to the subtracter 413 where a time parameter $\tau_P$ is subtracted therefrom. This time parameter $\tau_P$, which specifies a time to reach the target level, has a value $0<\tau_P<1$; this parameter $\tau_P$ is supplied from a parameter memory 53.

The subtracted output from the subtracter 413 is supplied via the selector 411 to the time variable memory 412 and is written there. The data written in the memory 412 is read out after a unit time, and is supplied to the subtracter 413 where the time parameter $\tau_P$ is again subtracted from the data. The resultant output is supplied again to the time variable memory 412 to be written there.

The subtraction is repeated for each unit time, so that the amplitude level of the time variable signal decreases by $\tau_P$, providing the normalized linear waveform signal as shown in FIG. 5(*a*).

The output $\alpha_P$ of the differentiation circuit 41 is multiplied by the gain parameter $G_P$ by a multiplier 42. As a result, a waveform with the AC amplitude level reproduced as shown in FIG. 5(*d*) is acquired. The gain parameter $G_P$ is also read out from the parameter memory 53.

The output $\beta_{Pf}$ of the multiplier 42 is converted into an exponential functional waveform signal from a linear waveform signal by a logarithm/linear converter 43, providing a waveform as shown in FIG. 5(*e*).

The output $\beta_{PL}$ of the logarithm/linear converter 43 is supplied via the selector 44 to an adder-subtracter 45 where it is added to an amplitude parameter $L_P$, providing a signal with the reproduced DC amplitude level as shown in FIG. 5(*f*). The amplitude parameter $L_P$ is also read out from the parameter memory 53.

The output $\alpha_P$ of the differentiation circuit 41 is compared with a threshold level TL (see FIG. 5(*a*)) by a comparator 46. When the output $\alpha_P$ falls below the threshold level TL, the comparator 46 sends the request signal REQ to a control signal generator 47 (see FIG. 5(*b*)). This request signal REQ is supplied via a CPU interface 48 to the CPU 18 from the controller 47. Consequently, the initialization for generating the waveform of the next phase (P+1) is executed.

Every time the output $\alpha_P$ of the differentiation circuit likewise becomes smaller than the threshold level TL, the initialization is performed and waveforms of all the phases P are obtained.

The structure for generating the gain parameter $G_P$ of the multiplier 42 will now be described.

The output $E_P$ of the adder-subtracter 45 is held in a register 49 for each unit time.

The selector 44 selects the output $\beta_{PL}$ of the logarithm/linear converter 43 at the first half of each unit time, and selects the data $E_P$ held in the register 49 at the second half.

The amplitude parameter $L_P$ of the present phase P is read out from the parameter memory 53 at the first half of each unit time, and the amplitude parameter $L_{P+1}$ of the next phase (P+1) is read out at the second half.

The adder-subtracter 45 adds the output $\beta_{PL}$ of the logarithm/linear converter 43 received via the selector 44 to the amplitude parameter $L_P$ of the present phase P at the first half of each unit time. At the second half of the unit time, the adder-subtracter 45 subtracts the amplitude parameter $L_{P+1}$ of the next phase (P+1) read out from the parameter memory 53 from the data $E_P$ held in the register 49 received via the selector 44.

It should be apparent from the above that an envelope signal is acquired at the first half of each unit time while the gain parameter $T_{(P+1)L}$ of the next phase P is acquired at the second half.

The separation of a unit time into the first half and second half is for a case where there is one tone-ON channel. In other words, when there are a plurality of tone-ON channels, processing for each channel is time-divisionally executed in each unit time. In this case, therefore, the generation of an envelope signal for each channel and the generation of the gain parameter $T_{(P+1)}$ are time-divisionally executed in a period assigned on the time-divisional basis.

The gain parameter $T_{(P+1)L}$ acquired for each unit time from the adder-subtracter 45 is produced on the basis of $E_P$ made to have an exponential functional waveform. Accordingly, this gain parameter $T_{(P+1)L}$ is converted into a linear waveform by a linear/logarithm converter 50.

The linearly-converted gain parameter $T_{(P+1)f}$ is held in a register 51. The gain parameter $T_{(P+1)f}$ held in the register 41 is supplied via a selector 52 to the parameter memory 53 and written there in the next unit time.

The gain parameter $T_{(P+1)f}$ written in the parameter memory 53 is updated for each unit time. The gain parameter $T_{(P+1)f}$ at the time the output $\alpha_P$ of the differentiation circuit 41 reaches the threshold level TL is finally registered as the gain parameter $G_{P+1}$ of the next phase (P+1).

In this manner, the gain parameter $G_P$ is automatically produced in the envelope generator 12 during wave generation for each phase P.

The control signal generator 47 controls the operations of the individual sections, such as the selector 41, under the control of the CPU 18.

Figure 6:
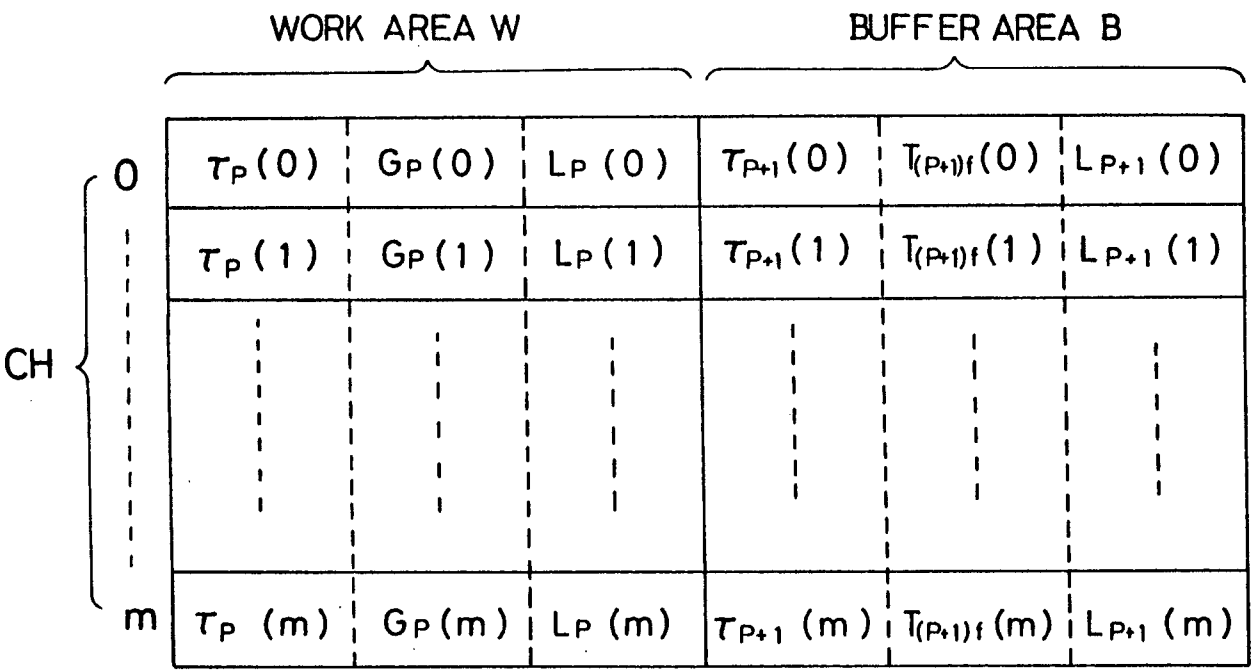
FIG. 6 is a diagram showing the configuration of a parameter memory in FIG. 4.

FIG. 6 illustrates the data storage arrangement of the parameter memory 53.

As illustrated, the parameter memory 53 has a double area structure with a work area W and a buffer area B. In the work area W are stored the parameters $\tau_P$, $G_P$ and $L_P$ of the present phase P. In the buffer area B are stored the parameters $\tau_{P+1}$, $T_{(P+1)f}(G_{P+1})$ and $L_{P+1}$ of the next phase (P+1). The areas W and B are each divided for individual channels CH(=0−m).

With the above arrangement, when the operation starts, the parameters $\tau_0$, $G_0$ and $L_0$ of the first phase 0 are written in the work area W, and the parameters $\tau_1$ and $L_1$ of the next phase 1 in the buffer area B. The writing of the parameters is executed by the CPU 18. The gain parameter $T_{1f}(G_1)$ of the next phase 1 is, however, computed during wave generation for the present phase 0 and is written in the buffer area B, as described above. This writing is automatically executed in the envelope generator 12.

When the wave generation for the first phase 0 is completed, the content of the buffer area B is transferred to the work area W; this processing is automatically carried out in the envelope generator 12. Then, the parameters $\tau_2$ and $L_2$ of the third phase 2 are written in the buffer area B by the CPU 18. The amplitude parameter $T_{2f}$ of the third phase 2 is generated during the processing for the second phase 1 and is stored in the buffer area B.

Likewise, every time the wave generation for each phase P is ended, the parameters $\tau$, T and L are transferred to the work area W from the buffer area B, the parameters $\tau$ and L are written in the buffer area B, and computation of the amplitude parameter G for the next phase (P+1) and writing of the computation result into the buffer area B are executed.

Figure 7:
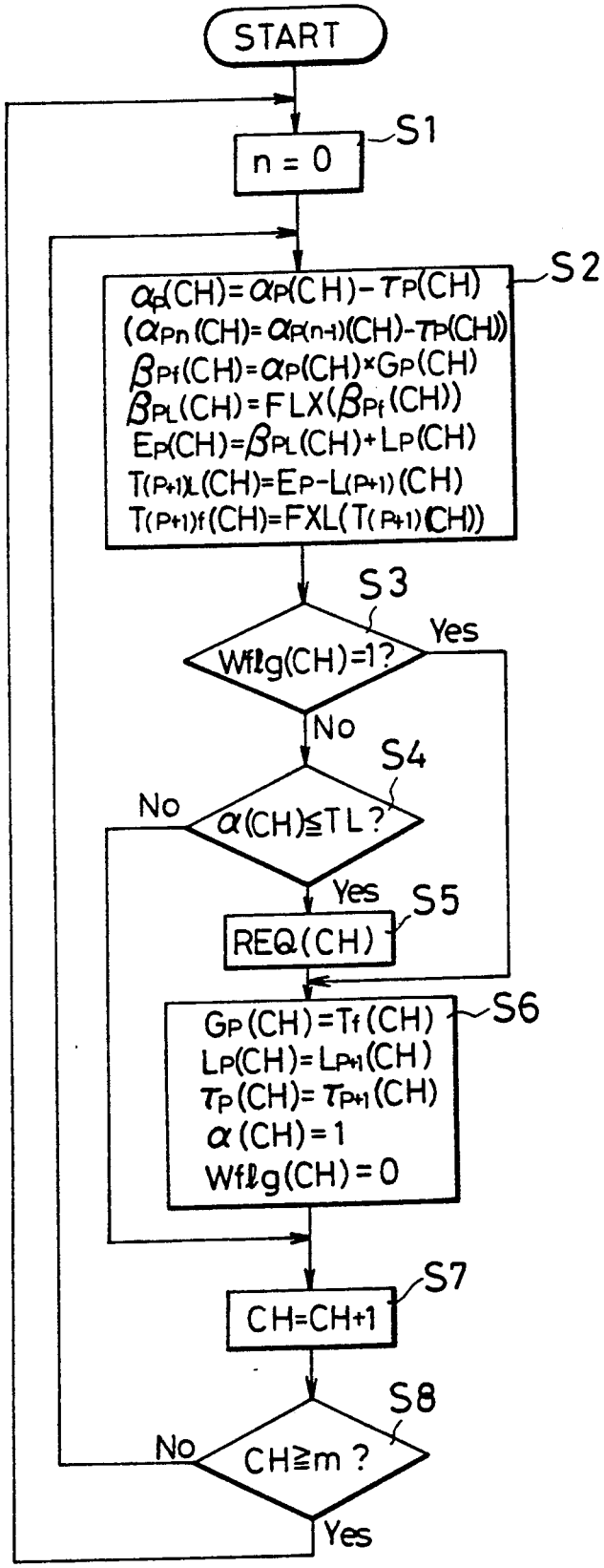
FIG. 7 is a flowchart for explaining the operation of the circuit shown in FIG. 4.

FIG. 7 is a flowchart illustrating an ordinary wave generating process and a process for enforcing transition of the phase P based on phase-change data.

The ordinary wave generating process will be described first.

Referring to this diagram, the first tone-ON channel 0 is specified by the CPU 18 (step S1).

Then, the wave generation for the channel 0 and the generation of the gain parameter $T_{(P+1)f}(0)$ of the next phase (P+1) are executed (step S2). In this step S2, "FLX" indicates logarithm/linear conversion and "FXL" linear/logarithm conversion.

Then, it is discriminated whether or not the write flag $W_{flg}$ (0) is 1 (step S3).

If $W_{flg}$ (0) is not 1, it is discriminated whether or not the output $\alpha_P$ (0) of the differentiation circuit 41 has reached the threshold level TL (step S4).

If this output has not reached the threshold level TL, the channel is switched to 1 from 0 (step S7).

It is then discriminated whether or not the channel CH has reached the maxim channel m (step S8). If the decision is affirmative, the flow returns to step S1, and, if not, the flow returns to step S2.

In this case, since the channel CH is 1, the flow returns to step S2. Consequently, the wave generation for the channel 1 and the generation of the gain parameter $T_{(P+1)f}$ (1) are performed.

Likewise, the wave generation and generation of the gain parameter $T_{(P+1)f}$ (CH) are executed until CH reaches the maximum channel m.

The above processing is for one unit time. Thereafter, the flow returns to step S1 from step S8, and the routines for the channel 0 to channel m are time-divisionally executed again in the next unit time.

During this processing, the comparator 46 sends the request signal REQ (CH) to the control signal generator 47 when the output $\alpha_P$ (CH) of the differentiation circuit 41 has reached the threshold level TL (step S5).

Then, the content of the buffer area B of the parameter memory 53 is automatically transferred to the work area W. Further, the CPU 18 writes the initial value "1" is written in the time variable memory 412 and sets the write flag $W_{flg}$ (CH) to "0" (step S6).

Figure 8:
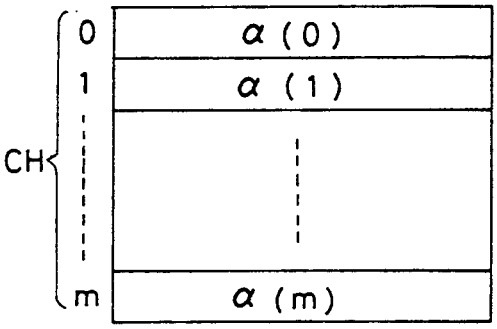
FIG. 8 is a diagram showing the configuration of a time variable memory in FIG. 4.

The processing of step S6 is executed only for the associated channel CH. Like the parameter memory 53, therefore, the time variable memory 412 of the differentiation circuit 41 is designed to have a data storage area for each channel CH. This is illustrated in FIG. 8. Likewise, the register for setting the write flag $W_{flg}$ (CH) is provided for each channel CH.

Thereafter, the flow advances to step S7 where the channel CH is updated. This time, therefore, the phase transitional processing involving steps S5 and S6 is executed for the next channel CH.

When the phase transitional processing for every channel CH is completed, the flow returns to step S1 from step S8 and the above-described processing will be carried out for the next phase P.

Figure 9:
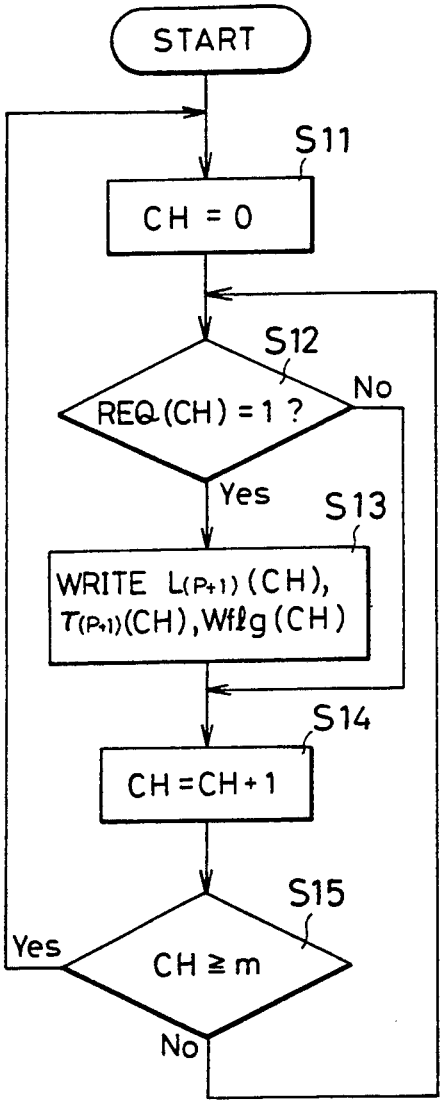
FIG. 9 is a flowchart for explaining the operation of the circuit shown in FIG. 4.

FIG. 9 is a flowchart illustrating the processing of the CPU 18 executed at the time of phase transition.

Referring to this diagram, the channel 0 is set first (step S11).

Then, it is discriminated whether or not the request signal REQ (CH) is present (step S12). If there is no request signal REQ (CH), the channel 1 is set (step S14).

It is then discriminated whether or not the set channel CH has reached the maximum channel m (step S15).

The flow returns to step S11 when CH has reached m, and returns to step S12 when it has not reached m.

In this case, since the set channel is 1, the flow returns to step S12. As a result, the above-described processing will be executed this time for the channel 1.

The same processing is repeated for each channel (CH). When CH has reached the maximum channel m, the flow returns to step S11 from step S15 and the processing for m channels will be executed in the next unit time.

When it is discriminated in step S12 that the request signal REQ is present, the parameters $\tau_{P+1}$ (CH) and $L_{P+1}$ (CH) are written in the buffer area B. When phase-change data is detected, the write flag $W_{flg}$ (CH) is set to "1."

The writing of the parameters $\tau_{P+1}$ (CH) and $L_{P+1}$ (CH) is carried out after the content of the buffer area B is transferred to the work area W.

A description will now be given of the processing of forcibly changing the phase P.

Upon detection of phase-change data, the CPU 18 reads a parameter specified by this phase-change data from the ROM 22. The CPU 18 then writes this parameter into the buffer area B. Finally, the CPU 18 sets the write flag $W_{flg}$ (CH) to "1."

Accordingly, it is discriminated in step S3 in FIG. 7 that the write flag $W_{flg}$ (CH) is "1." As a result, the content of the buffer area B is transferred to the work area W and the initial value "1" is written in the time variable memory 412.

Accordingly, a waveform of the phase specified by the phase-change data is produced.

Figure 10:
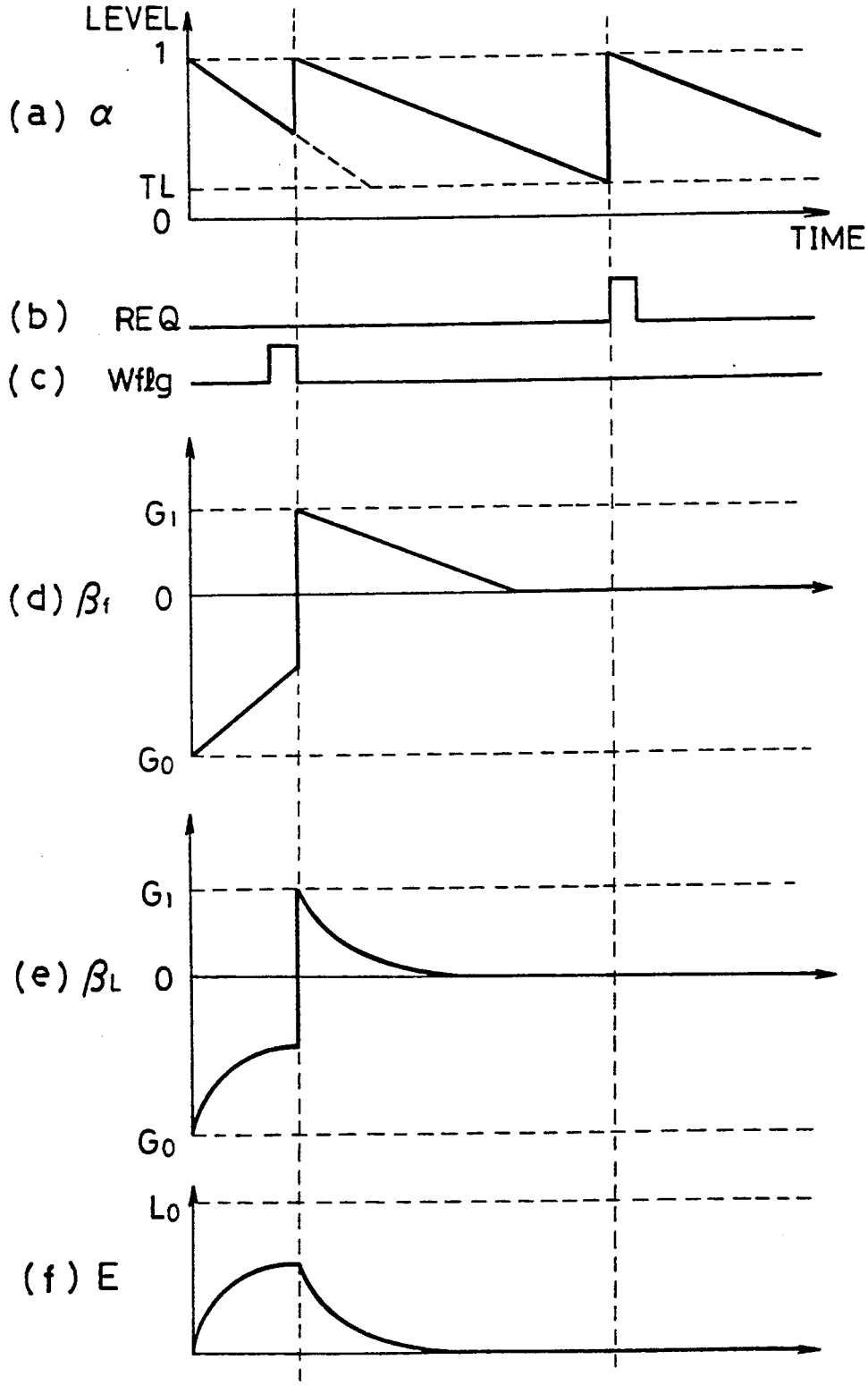
FIGS. 10(*a*)–10(*f*) are signal waveform diagrams relating to the operation of the circuit in FIG. 4 depicting the forced phase change from the middle of an attack waveform portion or phase.

FIG. 10(*a*)–10(*f*) illustrate enforced phase alteration from a middle of an attack portion.

In this case, the write flag $W_{flg}$ (CH) is set to "1" during the attack portion. Accordingly, a new waveform is forcibly produced from during the attack portion. FIG. 10 illustrates a case where an attenuating waveform is produced during the attack portion.

The mode for forcibly altering the phase P is not restricted to the type shown in FIGS. 10(*a*)–10(*f*) for example, the following modes are available.

(1) In a case where data indicating after touch is given from the touch sensor 21 shown in FIG. 1.

In this case, upon detection of the after touch data, the CPU 18 reads the parameter specified by this data from the ROM 22 and writes it in the buffer area B.

The content of the buffer area B is then transferred to the work area W, thus forcibly changing the phase.

Figure 11:
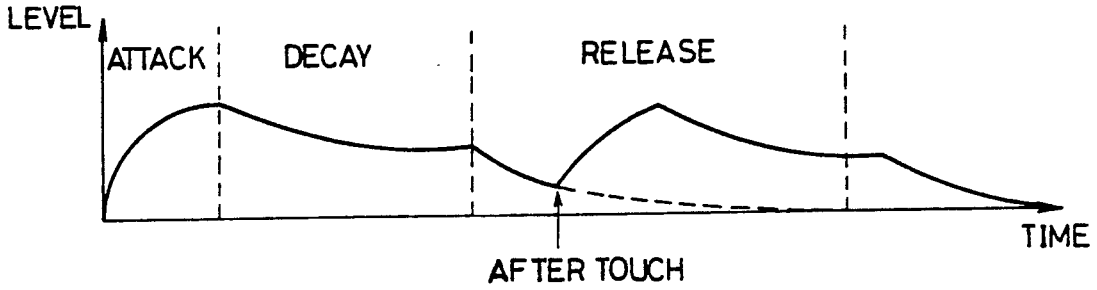
FIGS. 11 through 13 are signal waveform diagrams illustrating a phase change mode.

FIG. 11 exemplifies a waveform in this case where after touch data is detected during a release portion.

(2) In a case where data indicating key-OFF is given from the touch sensor 21 in FIG. 1.

Figure 12:
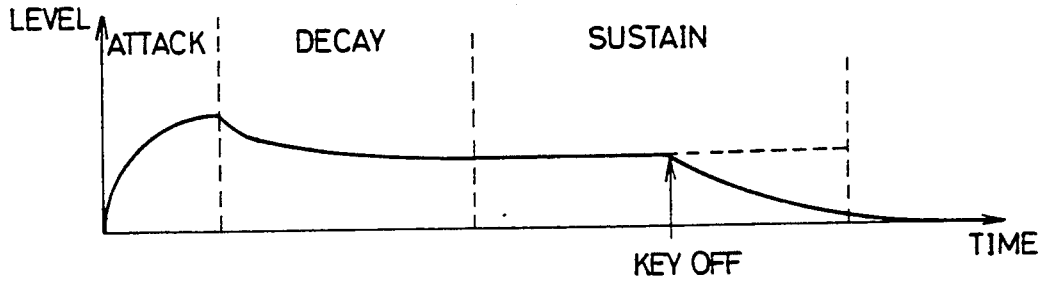

For instance, an electronic organ is designed to keep outputting a musical tone while a key is being depressed, and attenuate the musical tone when the key is released. When the key-OFF data is detected during a sustain portion as shown in FIG. 12, the parameter of the release portion is written in the buffer area B. Consequently, the phase is forcibly changed to the release portion from the sustain portion.

(3) In a case where a tremolo waveform is added to a musical tone signal.

Figure 13:
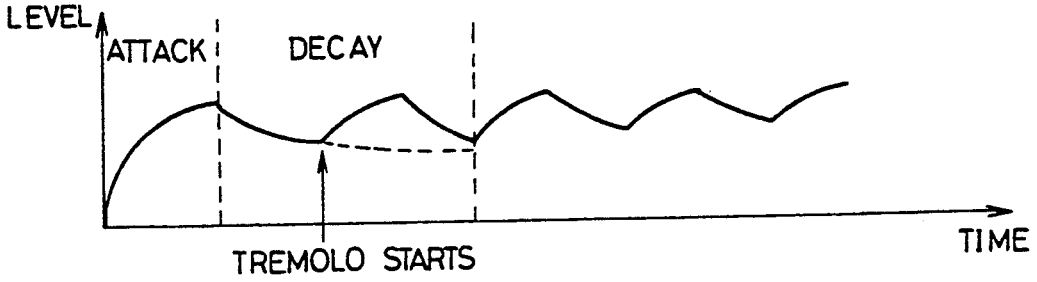

In this case, after phase-change data for specifying tremolo is detected, the write flag $W_{flg}$ is periodically set to "1" and two phases are alternately repeated, for example, thus providing the tremolo waveform as shown in FIG. 13.

According to the structure to add a tremolo waveform by forced alteration of the phase of an envelope signal, it is easier to add a tremolo waveform channel by channel or for each key as compared with the conventional arrangement that requires a tremolo adding circuit at the succeeding stage of the accumulator 14 shown in FIG. 1.

(4) In a case where a player properly edits the phase of an envelope signal as in a synthesizer.

In this case, the phase can be easily edited by executing the aforementioned phase alteration process at an editing position.

This embodiment described in detail above can also produce the same effects as the previous embodiment in addition to the following effects.

(1) The differentiation processing in the differentiation circuit 41 can be done by subtraction, not multiplication because the normalized time variable signal is output as a linear waveform signal. This feature can simplify the structure of the differentiation circuit 41.

(2) It is possible to simplify the structure of the comparator 46 which compares the output $\alpha_P$ of the differentiation circuit 41 with the threshold level TL. This is because outputting the time variable signal as a linear waveform signal can always permits the waveform of each phase P to reach the threshold level TL.

(3) It is possible to compel the phase alteration based on phase-change data since parameters for wave generation are stored in the ROM 22 for each phase, not for each envelope signal. In other words, the parameters are managed for each phase, not for each envelope signal.

In addition, even though the parameters are managed phase by phase, it is possible to generate an envelope signal selected by the timbre/envelope select switch of the panel switch section 19 for the following reason. The phases of the selected envelope signal are determined by the CPU 18 and parameters are read out from the ROM 22 based on the result of the decision.

Figure 14:
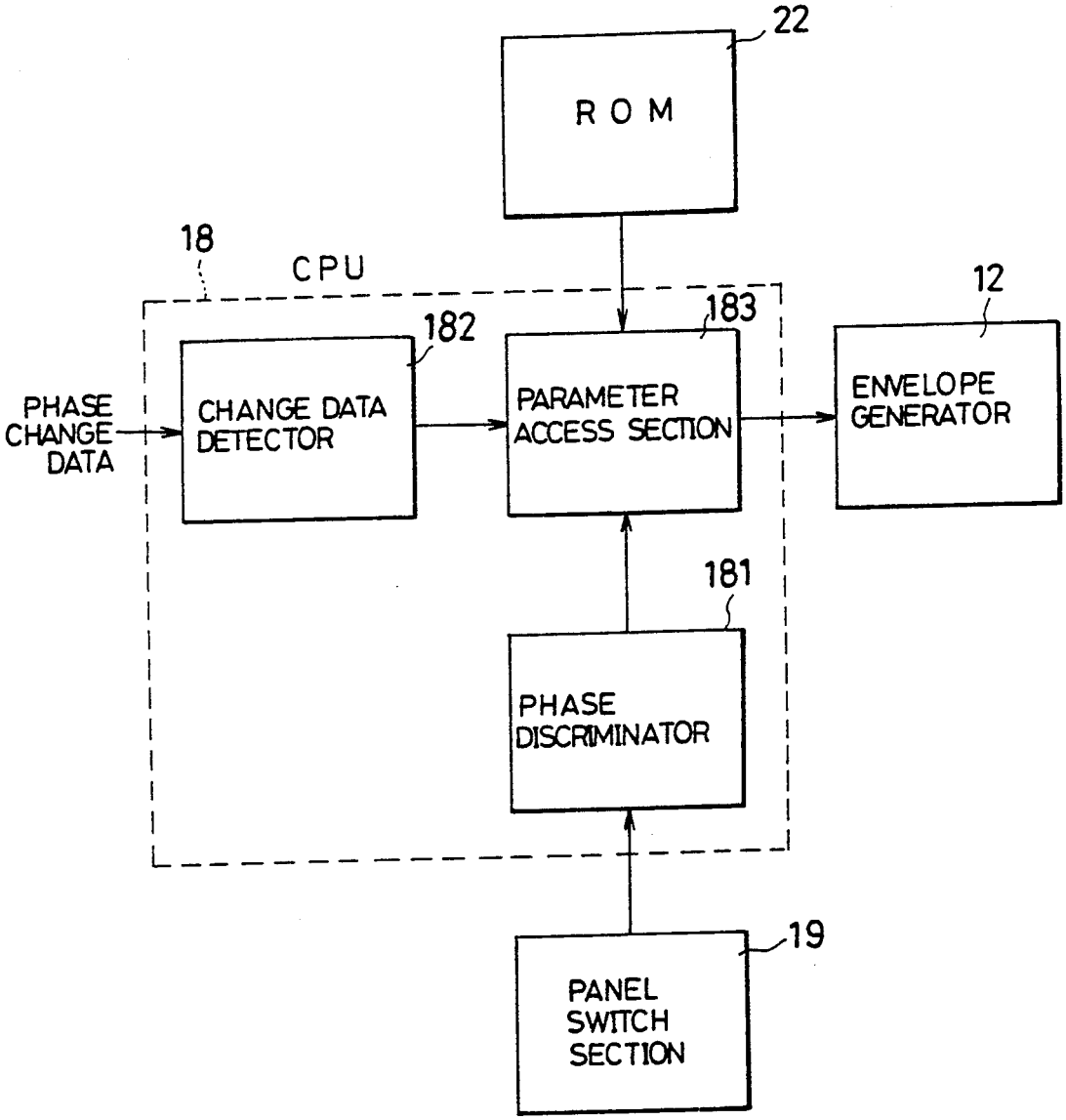
FIG. 14 is a block diagram illustrating part of the function of a CPU in FIG. 4.

FIG. 14 is a block diagram illustrating the blocked functions of the CPU 18 concerning the enforced phase alteration.

As illustrated, the CPU 18 comprises a phase discriminator 181, a change data detector 18 and a parameter access section 183.

The phase discriminator 181 determines the phases of an envelope signal selected by the timbre/envelope switch of the panel switch section 19.

The change data detector 182 detects phase-change data.

The parameter access section 183 sequentially reads out parameters of the phase determined by the phase discriminator 181, and supplies them to the envelope generator 12. When phase-change data is detected by the change data detector 182, the parameter access section 183 reads out parameters of the phase specified by this phase-change data from the ROM 22, and replaces the parameters already supplied to the envelope generator 12 with the read ones, thereby forcibly changing the phase.

Conventionally, the parameters are stored in the ROM 22 for each envelope signal. In addition, the conventional apparatus does not have the phase discriminator 181 nor the change data detector 182, so that it cannot compel the phase alteration.

(4) The phase can be forcibly changed even in a case where the parameters are stored in the ROM 22 for each envelope signal, not phase by phase. This is because that the parameter memory 53 having a double area structure is provided as a buffer memory and the CPU 18 manages the parameters phase by phase using this memory 53.

Figure 15:
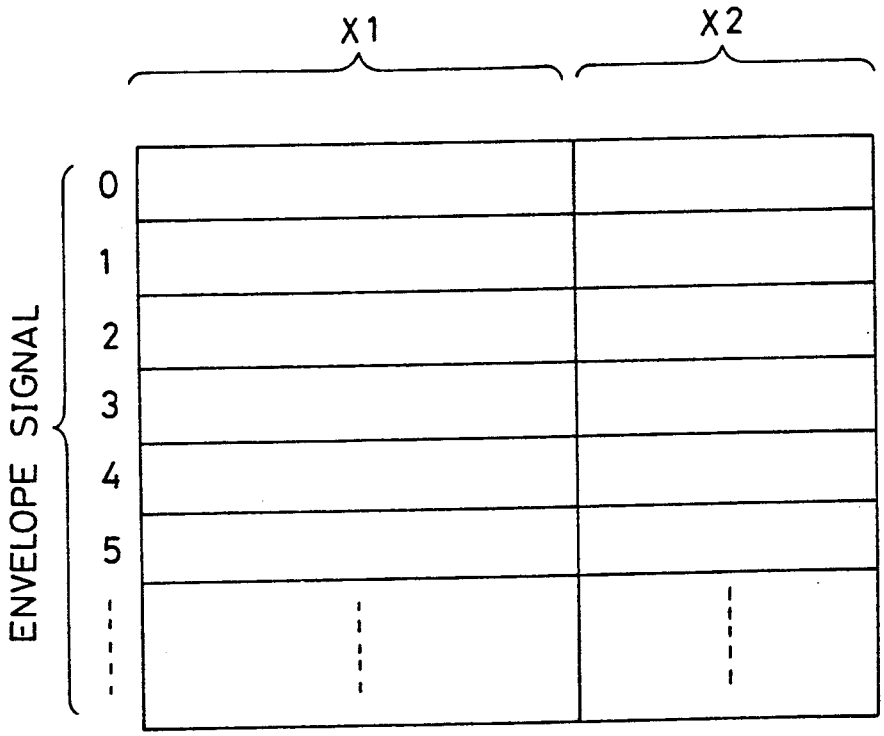
FIG. 15 is a diagram exemplifying the configuration of a ROM in FIG. 4.

For instance, as shown in FIG. 15, the ROM 22 is separated into a plurality of areas for individual envelope signals. Each subarea is further divided into two areas X1 and X2, the former area Xl storing parameters of an associated envelope signal for each envelope signal and the latter storing parameters of the phase, specified by phase-change data, for each phase.

With the above arrangement, parameters of the envelope signal selected by the timbre/envelope select switch are read out from the area Xl while those of the phase specified by phase-change data are read out from the area X2. In this case, the parameters from the area X1 are held in the parameter memory 53 phase by phase. When phase-change data is detected, therefore, replacing parameters in the memory 53 can forcibly change the phase.

According to this embodiment, the provision of the parameter memory 53 as a buffer memory can ensure forced alteration of the phase P even if parameters are stored in the area X1 of the ROM 22 for each envelope signal.

Figure 16:
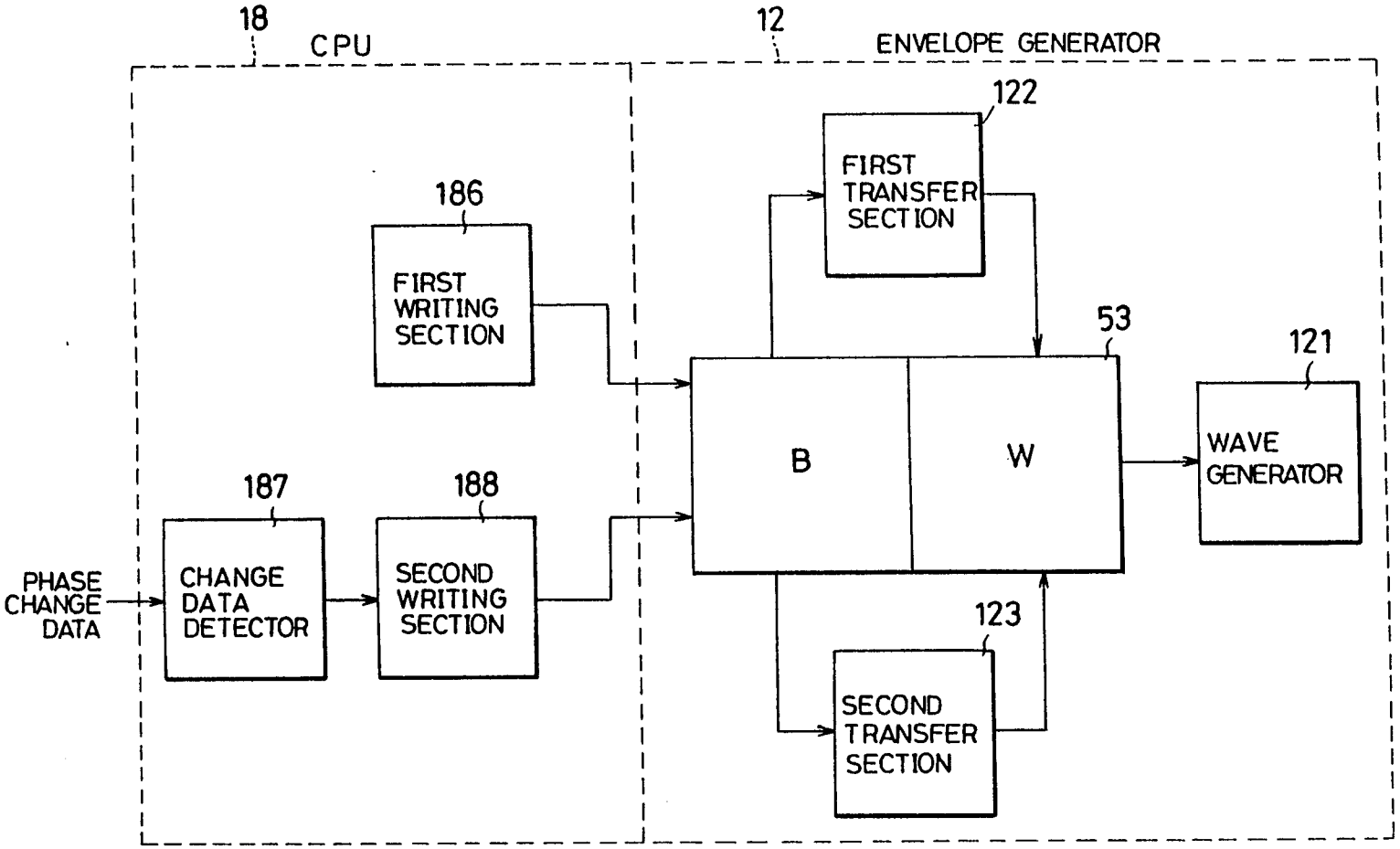
FIG. 16 is a block diagram showing the accessing structure of the parameter memory in FIG. 4.

FIG. 16 is a block diagram illustrating the blocked functions of the accessing structure of the parameter memory 53 in this embodiment.

As illustrated, the envelope generator 12 has a wave generator 121, first transfer section 122, and second transfer section 123 in addition to the parameter memory 53. The CPU 18 has a first writing section 186, change data detector 187 and second writing section 188.

The wave generator 121 generates a waveform based on the parameters stored in the work area W.

The first transfer section 122 transfer the content of the buffer area B to the work area W after the wave generation of the wave generator 121 is completed.

The first writing section 186 writes parameters of the next phase into the buffer area B after data transfer by the first transfer section 122 is completed.

The change data detector 187 detects phase-change data.

When phase-change data is detected, the second writing section 188 writes parameters of the phase specified by this data into the buffer area B.

The second transfer section 123 transfers the content of the buffer area B to the work area W when writing by the second writing section 188 is completed.

With the above arrangement, the ordinary wave generating process is performed by the first transfer section 122 and first writing section 186. The phase alteration process, however, is carried out by the change data detector 187, second writing section 188 and second transfer section 123.

Although several embodiments of the present invention have been described above, this invention is not restricted to these particular types.

For instance, although the subtracter 413 for differentiation and the adder-subtracter 45 for generating an envelope signal and gain parameter $T_{(P+1)L}$ are provided separately, one of the elements may be designed to serve as the other and may be driven on a time-divisional basis.

The previous embodiment has been described with reference to a case where the gain parameter $T_{(P+1)}$ is written in the buffer area B of the parameter memory 53 for each unit time. According to this invention, however, the gain parameter $T_{(P+1)}$ held in the register 51 may be written as a gain parameter $G_P$ in the work area W of the parameter memory 53 only at the time of phase alteration. This arrangement can eliminate the need for the area in the buffer area B in FIG. 6 to store the gain parameter $T_{(P+1)}$, thus making it possible to reduce the required memory capacity.

Although the description of the previous embodiments has been given with reference to a case where the present invention is applied to generation of an envelope signal to add dynamics to a musical tone signal, this invention can also be applied to generation of an arbitrary functional waveform.

Although the previous embodiments have been described with reference to a case where parameters are stored in advance in the ROM 22, the CPU 18 may be designed to successively generate parameters phase by phase.

In the previous embodiments, the phase is changed using a flag; however, the phase alteration may be conducted through interrupt processing, not using the flag.

Further, the structure for forcibly changing the phase may be applied to apparatuses other than the one which generates an envelope signal using a normalized time variable signal.

In addition to the above embodiments and modifications, the present invention is intended to cover various modifications and equivalent arrangements included within the scope and spirit of the invention.

According to the present invention, as described above, a normalized time variable signal is generated and the AC amplitude level and DC amplitude level of this time variable signal are reproduced, so that the wave generating time does not change even with a change in target level. Further, it is unnecessary to change what is to be compared for discriminating whether or not the target level is reached. Furthermore, even when there is a slight change up to the target level, an envelope signal having the desired waveform can be acquired.

As waveform generating data is managed phase by phase, not for each envelope signal, according to the present invention, the phase can forcibly be altered.

In addition, since the present invention employs a buffer memory with a double area structure, the phase can forcibly be changed even when waveform generating data is managed for each envelope signal.

What is claimed is:

1. A signal generating apparatus that generates an envelope signal, said envelope signal including a plurality of phases, each phase being defined as an envelope signal waveform portion and each phase having a waveform transition, said signal generating apparatus comprising:

time variable signal generating means for generating a normalized time variable signal for each phase of the envelope signal;

AC amplitude level reproducing means for processing said normalized time variable signal to reproduce an AC amplitude level of an unnormalized time variable signal whose normalization yields said normalized time variable signal; and DC ampliutide level reproducing means for processing said normalized time variable signal to reproduce a DC amplitude level of said unnormalized time variable signal.

2. The apparatus of claim 1, wherein said signal generating means includes a differentiation circuit.

3. The apparatus of claim 1, wherein said AC amplitude level reproducing means includes:

multiplying means for multiplying said normalized time variable signal by a gain parameter to thereby reproduce said AC amplitude level.

4. The apparatus of claim 1, wherein said DC amplitude level reproducing means includes:

adding means for adding said unnormalized time variable signal to an amplitude parameter to thereby reproduce said DC amplitude level.

5. The apparatus of claim 1, wherein said desired envelope signal has an exponential waveform, wherein said normalized time variable signal has a linear waveform, and wherein said AC amplitude level reproducing means includes:

logarithm/linear conversion means for converting said normalized time variable signal having a linear waveform to a time variable signal having an exponential waveform.

6. The apparatus of claim 3, wherein said AC amplitude level reproducing means includes:

means for automatically generating said gain parameter.

7. The apparatus of claim 6, wherein said automatic generating means includes:

means for generating a first gain parameter for a present phase; and means for generating a second gain parameter for a subsequent phase during the present phase by using said first gain parameter.

8. The apparatus of claim 6, wherein said Ac amplitude level reproducing means includes:

means for time-divisionally executing both processing of said normalized time variable signal and said automatic generation of said gain parameter.

9. A signal generating apparatus that generates an envelope signal, said envelope signal including a plurality of phases, each phase being defined as an envelope signal waveform portion and each phase having a waveform transition, said signal generating apparatus comprising:

phase discriminating means for discriminating phases of a selected envelope signal;

wave generating means for sequentially generating waveforms having said discriminated phases to thereby yield a desired envelope signal; and phase change means for altering the discriminated phase whose waveform is being generated by said wave generating means by using phase-change data which indicates how said discriminated phase is to be changed.

10. The apparatus of claim 9, wherein said wave generating means comprises:

memory means for storing waveform generating data for each phase which is capable of being discriminated by said discriminating means;

first reading means for sequentially reading the stored waveform generating data for each of the discriminated phases that has actually been discriminated by said phase discriminating means;

waveform outputting means for outputting a waveform based upon read waveform generating data; and wherein said phase change means comprises:

change data detecting means for detecting said phase-change data;

second reading means for reading waveform generating data corresponding to the phase specified by said detected phase-change data from said memory means; and replacing means for replacing said waveform generating data read out by said first reading means with waveform generating data read out by said second reading means.

11. A signal generating apparatus that generates an envelope signal, said envelope signal including a plurality of phases, each phase being defined as an envelope signal waveform portion and each phases having a waveform transition, said signal generating apparatus comprising:

first memory means for storing first waveform generating data for a first phase;

second memory means for storing second waveform generating data for a second phase that follows said first phase;

wave generating means for generating a first waveform based on said stored first waveform generating data;

first transfer means for transferring said stored second waveform generating data to said first memory means after said first waveform has been generated;

first writing means for writing third waveform generating data for a third phase into said second memory means after said first transfer means has transferred said stored second waveform generating data to said first memory means;

change data detecting means for detecting phase-change data, said phase-change data indicating a changed phase to be generated by said wave generating means;

second writing means for writing, into said second memory means, changed waveform generating data corresponding to said changed phase; and second transfer means for transferring said changed waveform generating data into said first memory means after said changed waveform generating data has been written into said second memory means.

* * * * *